US005404074A

United States Patent [19]

Watanabe et al.

[11] Patent Number: 5,404,074

[45] Date of Patent: Apr. 4, 1995

[54] IMAGE DISPLAY

[75] Inventors: Hidetoshi Watanabe; Toshio Ohoshi, both of Tokyo, Japan

[73] Assignee: Sony Corporation, Tokyo, Japan

[21] Appl. No.: 77,321

[22] Filed: Jun. 16, 1993

Related U.S. Application Data

[63] Continuation of Ser. No. 811,983, Dec. 23, 1991, abandoned.

[30] Foreign Application Priority Data

Dec. 25, 1990 [JP] Japan ..... 2-412914

[51] Int. Cl.[6] ..... H01J 1/62

[52] U.S. Cl. ..... 313/495; 345/74; 315/169.1

[58] Field of Search ..... 340/718, 719, 781, 760, 340/762, 766, 774, 782; 313/495, 498, 499, 500, 503, 505, 506; 315/169.1, 169.3, 169.4; 345/74, 75, 76, 84, 205, 204

[56] References Cited

U.S. PATENT DOCUMENTS

| | | | |
|---|---|---|---|
| 3,855,499 | 12/1974 | Yamada et al. | 340/781 |
| 4,035,689 | 7/1977 | Ogle et al. | 340/774 |
| 4,042,854 | 8/1977 | Luo et al. | 345/76 |
| 4,386,352 | 5/1983 | Nonomura et al. | 340/784 |
| 4,429,305 | 1/1984 | Hosokawa et al. | 340/784 |
| 4,909,602 | 3/1990 | Kaneko et al. | 340/784 |
| 5,015,912 | 5/1991 | Spindt et al. | 313/496 |
| 5,153,483 | 10/1992 | Kishino et al. | 315/169.1 |

*Primary Examiner*—Ulysses Weldon
*Assistant Examiner*—Xiao M. Wu
*Attorney, Agent, or Firm*—Hill, Steadman & Simpson

[57] ABSTRACT

An image display comprises a plurality of picture elements arranged in a matrix and each connected to a switching thin film transistor and a capacitor. The switching thin film transistor is controlled to drive the corresponding picture element. The image display is capable of areal luminance and of displaying images in a satisfactorily high brightness.

5 Claims, 3 Drawing Sheets

IMAGE DISPLAY

This is a continuation of application Ser. No. 07/811,883, filed Dec. 23, 1991, now abandoned.

BACKGROUND OF THE INVENTION

1. Field of the Invention

The present invention relates to an image display, such as a color display, and, more particularly, to a thin image display.

2. Description of the Prior Art

A microtips type display such as proposed in Japan Display '86, pp. 512–515 employs micro cold cathodes as electron emitters. This known display has cathodes as electron emitters formed in the shape of a circular cone of 1.0 μm or less in diameter on a substrate by a semiconductor device fabricating process, electrodes formed under the cathodes, and gate electrodes formed on an insulating layer surrounding the cathodes. The cathodes arrays are arranged in an X-Y matrix and are driven individually. When an electric field of $10^6$ V/cm or higher is applied across the conical cathode and the corresponding gate electrode, field emission occurs to emit an electron beam from the tip of the cathode. The cathodes arrays are thus driven in an X-Y driving mode to project electron beams selectively on the fluorescent screen of the display to display images.

Since X-Y driving is line scanning, the duration of luminance of each picture element (each cathodes array) is very short and hence the image cannot be displayed in a satisfactory brightness. Therefore, the luminous intensity of the picture element must be increased, namely, an increased anode voltage must be applied, to display images in a satisfactory brightness, phosphor for high voltage electron beam must be used and hence only limited phosphor can be used.

SUMMARY OF THE INVENTION

The present invention has been made in view of the foregoing problems in the conventional display and it is therefore an object of the present invention to provide an image display using phosphor for low voltage electron beam and capable of displaying images in a satisfactorily high brightness.

The present invention provides an image display having a plurality of picture elements (cathodes arrays) arranged in a matrix and each having micro cold cathodes, switching thin film transistors connected respectively to the picture elements, and capacitors connected respectively to the picture elements.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
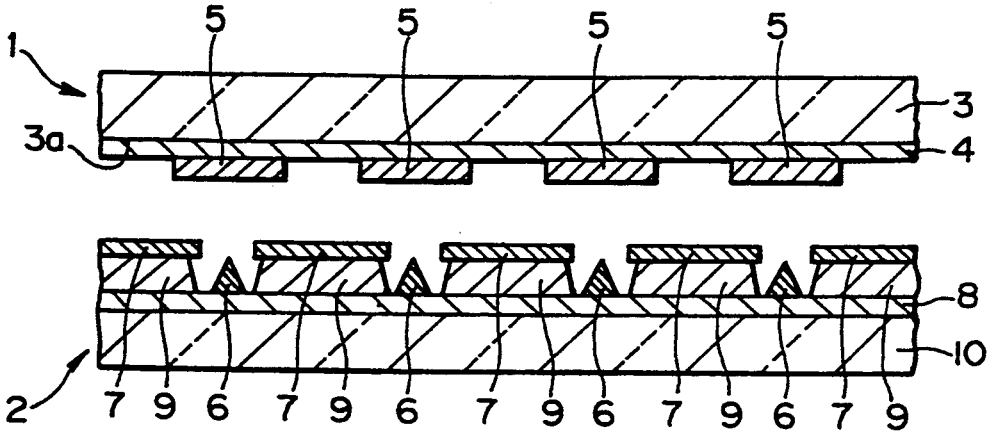
FIG. 1 is an enlarged sectional view of an essential portion of an image display embodying the present invention.

Referring to FIG. 1, an image display embodying the present invention comprises a front panel 1 provided on its inner surface with fluorescent stripes, and a cathode panel 2 serving as an electron emission source.

The front panel 1 comprises of a glass plate 3 disposed opposite to the cathode panel 2, a transparent anode 4 formed of ITO (indium tin oxide) over the inner surface 3a of the glass plate 3, and a fluorescent screen formed by forming fluorescent stripes 5, i.e., red, green, and blue fluorescent stripes and black carbon stripes, in a predetermined pattern on the transparent anode 4.

Figure 2:
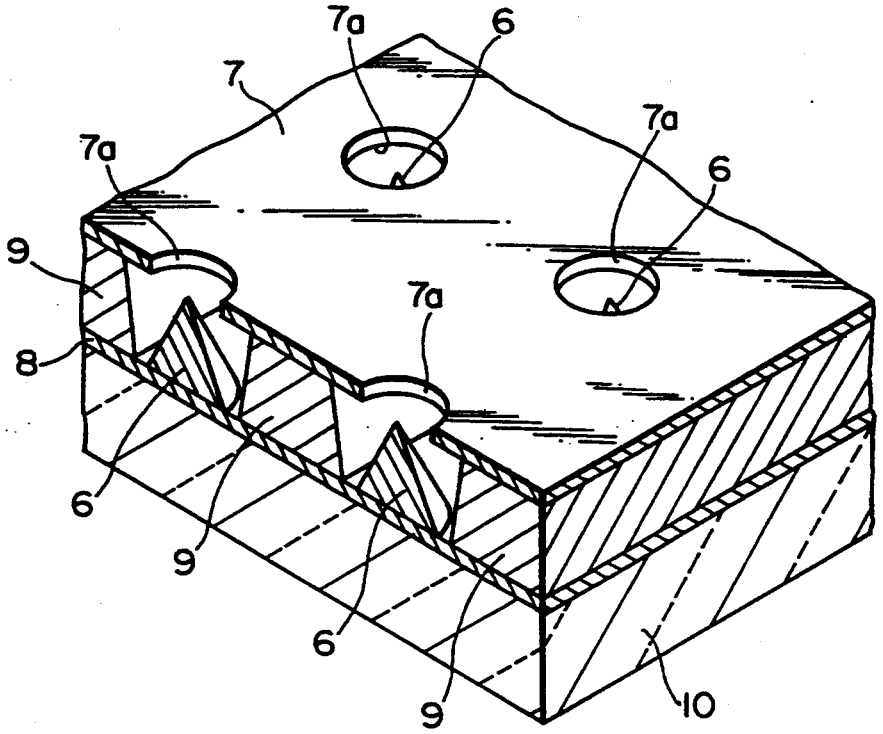
FIG. 2 is an enlarged partially cutaway perspective view of an essential portion of micro cold cathodes.

The cathode panel 2 has micro cold cathodes serving as cathodes arrays arranged in a matrix. Each cathodes array is connected to a switching thin film transistor and a capacitor. Referring to FIG. 2, the micro cold cathode comprises cathodes 6, i.e., electron emission sources, a gate electrode 7 for making the cathodes emit electron beams, control lines 8 for giving voltage to the cathodes 6, an insulating layer 9 for insulating the control lines 8 from the gate electrode 7, and a base plate 10. The cathodes 6, the gate electrode 7, the control lines 8 and the insulating layer 9 are formed by a semiconductor device fabricating process on the base plate 10.

The cathodes 6 are micro emitters formed of molybdenum, tungsten or lanthanum hexaboride ($LAB_6$) in the shape of a micro circular cone of 1.0 μm or less in diameter. When an electric field is applied to the cathode 6, an electron beam is emitted from the tip of the cathode 6. The insulating layer 9 surrounds the cathodes 6, and the gate electrode 7 formed over the insulating layer 9 has circular holes through which electron beams are emitted from the tips of the cathodes 6 toward the fluorescent stripes 5.

Figure 3:
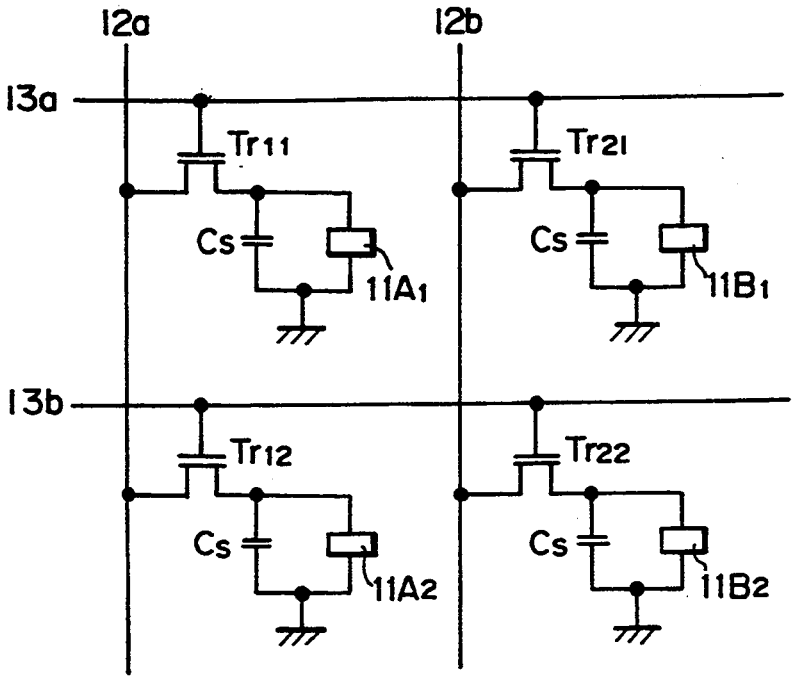
FIG. 3 is a circuit diagram of an equivalent circuit of the image display embodying the present invention.
Figure 4:
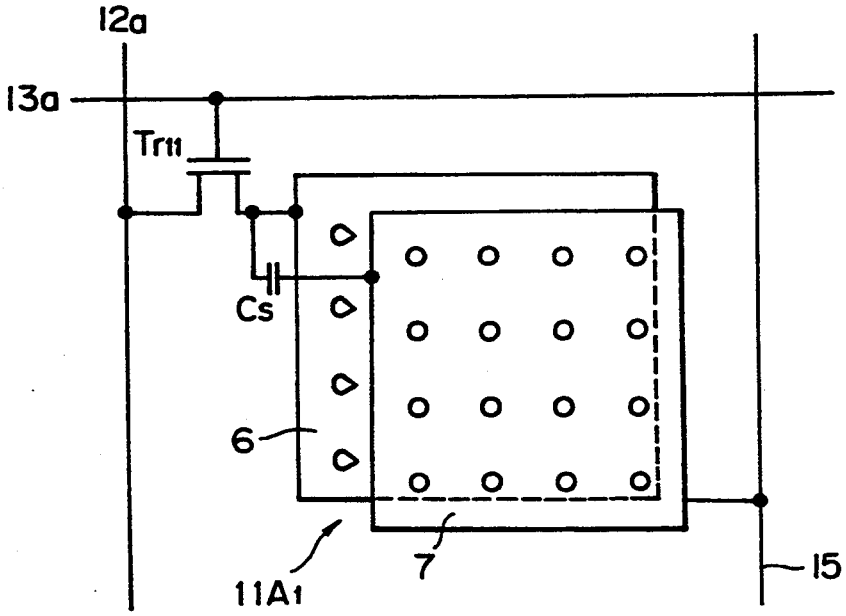
FIG. 4 is a typical circuit diagram of an equivalent circuit of a picture element.

A group of several to one thousand of cathodes 6 forms a single cathodes array. A plurality of cathodes array are arranged in a matrix on the glass plate 10. As shown in an equivalent circuit in FIG. 3, a storage capacitor Cs, i.e., a capacitor, is connected in parallel to each of picture elements $\mathbf{11A_1}$, $\mathbf{11A_2}$, $\mathbf{11B_1}$ and $\mathbf{11B_2}$ to suppress flicker noise. The picture elements $\mathbf{11A_1}$ and $\mathbf{11A_2}$ in a vertical picture element row are connected through switching thin film transistors $Tr_{11}$ and $Tr_{12}$, respectively, to a common signal line **12*a*, and the picture elements $\mathbf{11B_1}$ and $\mathbf{11B_2}$ in another vertical picture element row are connected through switching thin film transistors $Tr_{21}$ and $Tr_{22}$, respectively, to a common signal line 12*b*. The current that flows through the thin semiconductor film of each switching thin film transistors $Tr_{11}$, $Tr_{12}$, $Tr_{21}$ and $Tr_{22}$ is controlled by applying an electric field vertically to the thin semiconductor film. The switching thin film transistors $Tr_{11}$, $Tr_{12}$, $Tr_{21}$ and $Tr_{22}$ can be formed on the same plane simultaneously with the micro cold cathode by a semiconductor device fabricating process. The gates of the transistors $Tr_{11}$ and $Tr_{21}$ connected to the picture elements $\mathbf{11A_1}$ and $\mathbf{11B_1}$ in a horizontal picture element row are connected to a common control line 13*a*, and the gates of the transistors $Tr_{12}$ and $Tr_{22}$ connected to the picture elements $\mathbf{11A_2}$ and $\mathbf{11B_2}$ in another horizontal picture element row are connected to a common control line 13*b*. The respective gate electrodes 7 of the picture elements $\mathbf{11A_1}$, $\mathbf{11A_2}$, $\mathbf{11B_1}$ and $\mathbf{11B_2}$ are connected to a common bias line 15 as shown in FIG. 4**, in which only the picture element $\mathbf{11A_1}$ is shown typically in an equivalent circuit.

When the control line 13*a* connected to the horizontal row of the picture elements 11$A_1$and 11$B_1$turns on, the switching thin film transistors $Tr_{11}$ and $Tr_{21}$ are turned ON to store charge in the storage capacitors Cs of the picture elements 11$A_1$ and 11$B_1$ through the signal lines 12*a* and 12*b*. Then, the picture elements 11$A_1$ and 11$B_1$ emits electron beams owing to the charge stored in the storage capacitors Cs. Consequently, the fluorescent stripe 5 formed on the inner surface 3*a* of the front panel 1 corresponding to the electron beams remains continuously luminous for, for example, 1/60 sec. It is possible to turn all the control lines ON simultaneously for areal luminance.

Figure 5:
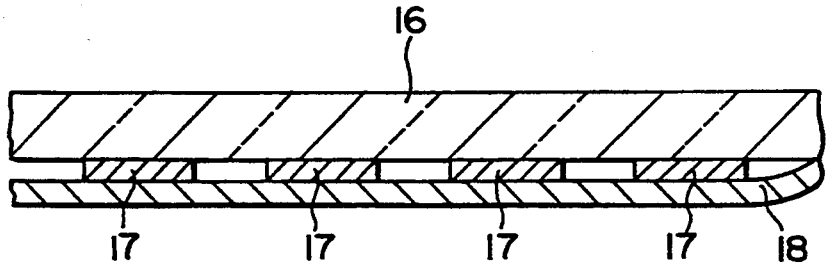
FIG. 5 is an enlarged sectional view of a front panel in a modification of the panel.

The duration of luminance in the image display embodying the present invention is longer than that in the conventional image display of an X-Y drive system, and the image display of the present invention is capable of displaying images in a satisfactorily high brightness and in a satisfactorily high resolution. Since the duration of luminance is comparatively long, the accelerating voltage applied to the transparent anode electrode 4 provided on the front panel 1 may be reduced and hence the image display of the present invention may employ phosphor for low voltage electron. Accordingly, degassing from the fluorescent screen is reduced and, consequently, the deterioration of the vacuum and contamination are suppressed. Naturally, a fluorescent screen for an ordinary CRT may be employed when a high voltage is used for driving. The present invention may employ a fluorescent screen for either high-speed electron beams or low-speed electron beams. When a fluorescent screen for high-speed electron beams is employed, fluorescent stripes 17 are formed in a predetermined pattern on a glass plate 16, and a metal film 18, such as an aluminum film, is formed over the fluorescent stripes 17 as shown in FIG. 5. In the image display in this embodiment, a bias is applied to the gate electrode 7 and signal is applied to the cathodes 6 to reduce the load on the element.

As is apparent from the foregoing description, the image display in accordance with the present invention is provided with the switching thin film transistor and the capacitor for each picture element, and hence the image display is capable of areal luminance, of displaying images in a satisfactorily high brightness and in a satisfactorily high resolution. The image display of the present invention requires a comparatively low accelerating voltage, which expands the range of selection of the fluorescent screen.

Although the invention has been described in its preferred form with a certain degree of particularity, obviously many changes and modifications are possible therein. It is therefore to be understood that the present invention may be practiced otherwise than as specifically described herein without departing from the scope and spirit thereof.

What is claimed is:

1. In an image display comprising a plurality of picture elements arranged in a matrix, each picture element comprising a light emitting material on an anode, and a plurality of micro cold cathodes for emitting a beam of electrons for striking the light emitting material to cause the material to emit light, the improvements comprising means for increasing a duration of the luminescence in the display, said means comprising the plurality of micro cold cathodes being driven by a switching thin film transistor and being connected in parallel to a capacitor.

2. In an image device according to claim 1, wherein each picture element includes a gate electrode being insulated by a layer of material from the plurality of micro cold cathodes, said gate electrode being connected in series with the capacitor.

3. In an image display comprising a plurality of picture elements arranged in a matrix, each picture element comprising a light emitting material on an anode, and a plurality of micro cold cathodes for emitting a beam of electrons for striking the light emitting material to cause the material to emit light, the improvements comprising means for increasing a duration of the luminescence in the display, said means comprising the plurality of micro cold cathodes of each picture element being driven by a single switching thin film transistor and being connected in parallel to a capacitor.

4. In an image device according to claim 3, wherein each picture element includes a gate electrode being insulated by a layer of material from the plurality of micro cold cathodes, said gate electrode being connected in series with the capacitor.

5. In an image display comprising a plurality of picture elements arranged in a matrix, each picture element comprising a light emitting material on an anode, a plurality of micro cold cathodes, and a gate electrode being positioned between the anode and micro cold cathodes and being insulated by a layer of material from the plurality of micro cold cathodes, said gate electrode having an aperture aligned with each micro cold cathode so the cathode can emit a beam of electrons through each aperture for striking the light emitting material to cause the material to emit light, the improvements comprising means for increasing a duration of the luminescence in the display and for suppressing flicker noises therein, said means comprising the plurality of micro cold cathodes of each picture element being driven by a single switching thin film transistor and being connected in parallel to a capacitor.

* * * * *